US008171672B2

(12) United States Patent
Plavnik et al.

(10) Patent No.: US 8,171,672 B2
(45) Date of Patent: May 8, 2012

(54) OUTPUT SHAFT, TEETER LEVER AND PINION GEAR ARRANGEMENT FOR PNEUMATIC DIFFERENTIAL ENGINE

(75) Inventors: Gennady Plavnik, Indian Creek, IL (US); David C. Griffis, Round Lake, IL (US); Michael O'Neill, Round Lake Beach, IL (US)

(73) Assignee: Wabtec Holding Corp., Wilmerding, PA (US)

( * ) Notice: Subject to any disclaimer, the term of this patent is extended or adjusted under 35 U.S.C. 154(b) by 28 days.

(21) Appl. No.: 12/595,850

(22) PCT Filed: May 1, 2008

(86) PCT No.: PCT/US2008/062157

§ 371 (c)(1),
(2), (4) Date: Mar. 24, 2010

(87) PCT Pub. No.: WO2008/137507

PCT Pub. Date: Nov. 13, 2008

(65) Prior Publication Data

US 2010/0170158 A1 Jul. 8, 2010

Related U.S. Application Data

(60) Provisional application No. 60/927,325, filed on May 3, 2007.

(51) Int. Cl.
*E05F 15/02* (2006.01)

(52) U.S. Cl. ..... 49/334; 49/366; 49/118

(58) Field of Classification Search ..... 49/116, 49/118, 122, 366, 333, 334
See application file for complete search history.

(56) References Cited

U.S. PATENT DOCUMENTS

| | | | | | |
|---|---|---|---|---|---|
| 776,397 | A | * | 11/1904 | Howard | 49/116 |
| 1,458,820 | A | * | 6/1923 | Griffith | 403/358 |
| 1,557,684 | A | | 10/1925 | Gottschalk | |
| 1,901,711 | A | * | 3/1933 | Forman | 49/118 |
| 2,791,420 | A | * | 5/1957 | Provost | 49/118 |
| 3,844,062 | A | * | 10/1974 | Daugirdas | 49/28 |
| 3,979,790 | A | | 9/1976 | Chiarappa | |
| 4,087,939 | A | * | 5/1978 | Elguindy et al. | 49/118 |
| 4,134,231 | A | | 1/1979 | Daugirdas et al. | |
| 4,152,870 | A | | 5/1979 | Knap | |
| 4,231,192 | A | | 11/1980 | Daugiras et al. | |
| 4,653,227 | A | | 3/1987 | Condon et al. | |
| 5,332,279 | A | * | 7/1994 | Golemis et al. | 296/146.4 |
| 6,530,178 | B1 | | 3/2003 | Kowalczyk et al. | |
| 6,883,784 | B1 | * | 4/2005 | Sloneker et al. | 254/366 |
| 2002/0189137 | A1 | * | 12/2002 | Cox et al. | 37/242 |
| 2006/0032384 | A1 | * | 2/2006 | Muniga et al. | 99/494 |
| 2008/0196312 | A1 | * | 8/2008 | Brown | 49/334 |

* cited by examiner

*Primary Examiner* — Gregory J. Strimbu
(74) *Attorney, Agent, or Firm* — The Webb Law Firm

(57) ABSTRACT

A removable teeter lever and gear assembly arrangement (100) for use with a pneumatic cylinder/differential engine for operating vehicle doors. The arrangement comprises a teeter lever (16), which is associated with the vehicle doors, a gear assembly (17) having a toothed portion and an output shaft (20) extending therethrough, and at least one securing member for removably securing and/or retaining the teeter lever (16) and the gear (17) on the output shaft (20). The securing member comprises at least one retention key (18*a*, 19*a*) which allows the arrangement to be easily disassembled for maintenance and/or replacement thereof.

3 Claims, 4 Drawing Sheets

OUTPUT SHAFT, TEETER LEVER AND PINION GEAR ARRANGEMENT FOR PNEUMATIC DIFFERENTIAL ENGINE

CROSS REFERENCE TO RELATED APPLICATIONS

This application claims the benefit of U.S. Provisional Patent Application No. 60/927,325, filed May 3, 2007, and entitled "Output Shaft, Teeter Lever and Pinion Gear Arrangement for Pneumatic Differential Engine", the entire disclosure of which is incorporated herein in its entirety.

BACKGROUND OF THE INVENTION

1. Field of the Invention

The present invention relates, generally, to a teeter lever for pneumatic cylinder/differential engine power-operated doors and, more particularly, to a removable teeter lever and removable gear for a pneumatic cylinder/differential engine for connecting an output shaft to connecting rods and, thence, to door panels of a mass transit vehicle.

2. Description of Related Art

Pneumatic cylinders have been utilized in mechanical systems to convert compressed air into linear reciprocating movement for opening and closing doors of passenger transportation vehicles. An example of this type of door actuating system is shown in U.S. Pat. No. 3,979,790.

Typically, pneumatic cylinders used in this environment consist of a cylindrical chamber, a piston and two end caps hermetically connected to the cylindrical chamber. The end caps have holes extending therethrough to allow the compressed air to flow into and out of the cylindrical chamber, to cause the piston to move in a linear direction, and to apply either an opening or closing force to the vehicle door.

Pneumatic cylinder/differential engine systems have also been designed for opening and closing doors of passenger transportation vehicles. Examples of these systems are shown in U.S. Pat. Nos. 4,231,192; 4,134,231; and 1,557,684.

As illustrated in FIG. 1, a known pneumatic differential engine consists of a large pneumatic cylinder 1 and a small pneumatic cylinder 2 attached to a housing 3. The large pneumatic cylinder 1 is closed at one end by a large cap 48. The small pneumatic cylinder 2 is closed at one end by a small cap 50. A large piston 4 and small piston 5 are installed inside of the cylinders 1 and 2, respectively. Pistons 4 and 5 are attached to the toothed rack 6 which is engaged with the gear 7. The gear 7 is permanently attached to the shaft 8, so that linear movement of the pistons 4 and 5 is converted into rotational movement of the output shaft 8. The teeter lever 9, as shown in FIG. 2, is welded to the end of the output shaft 8, and is connected by the rods 10, 11 and levers 12, 13 to the vertical shafts and arms linked to the vehicle door panels (not shown). As a result, rotational movement of the output shaft 8 causes rotational movement of the teeter lever 9 which causes opening and closing of the vehicle doors.

The small pneumatic cylinder 2 is constantly connected to a reservoir of compressed air, through opening 52 in small cap 50 so that a positive pressure is constantly applied to the surface 54 of the small piston 5 facing small cap 50. The large pneumatic cylinder 1 is connected to a three-way valve via opening 49, which provides connections to a source of compressed air during a door closing mode or to an exhaust member for exhausting the air from the large cylinder 1 during a door opening mode. The spring system 14 and sealing disk 15 provide cushioning of the movement of the large piston 4 at the end of the door opening stroke.

During a door closing mode, the air is admitted to large cylinder 1 through the three-way valve, as discussed above, and pressure is applied to the surface 56 of large piston 4 facing the large cap 48. Because of the difference in the surface area of large piston 4 and small piston 5, the application of air pressure within the large cylinder 1 causes the pistons 4 and 5 to move toward small cap 50 or to the right (as shown). Linear movement of the rack 6 is converted into counter-clockwise rotation of the gear 7 and output shaft 8 and, consequently, rotation of the teeter lever 9, which causes the doors to close.

During a door opening mode, the large cylinder 1 is connected to the exhaust valve of the three-way valve to allow the air in this large cylinder 1 to flow out due to pressure acting on the surface of the small piston 5 in small cylinder 2. As a result of this pressure differential, pistons 4 and 5 move toward large cap 48 or to the left (as shown), rotating the gear 7, shaft 8, and teeter lever 9 in the clockwise direction, as viewed in FIG. 1. The movement of the piston 4 toward the large cap 48 causes compression of the spring system 14, and linear movement of the sealing disk 15 toward a cushioning chamber 58.

Cushioning at the end of the door opening mode occurs as the disk 15 seals the exhaust opening 59 of cushioning chamber 58. The air flow out of the cylinder is restricted to a small orifice (not shown), slowing the movement of the pistons 4 and 5. This slowed movement allows the doors to continue opening at a slow speed (cushioning) until fully opened.

In the present engine design, the teeter lever 9 is welded to the output shaft 8 and the pinion gear 7 is secured to the output shaft by a roll pin inserted into a hole extending through the hub of the pinion gear and the shaft. This hole is drilled as a single operation with the pinion gear 7 already positioned on the welded shaft 8 and teeter lever 9 assembly. Once this hole is drilled, the pinion gear 7 and the welded shaft 8 and teeter lever 9 assembly become a matched set, inasmuch as the angular relationship of the teeter lever 9 to the pinion teeth determines the angular synchronization of the door panels to the position of the piston 4, and rack 6 assembly within the differential engine.

In order to remove the teeter lever 9 from the engine, the engine must be disassembled and the roll pin driven out of the gear 7 and the shaft 8 and teeter lever 9 assembly. If either the pinion gear 7 or the teeter lever 9 and shaft 8 assembly is damaged, all of these components must be replaced in order to restore the differential engine to operation.

It can be observed from the design of the existing differential engine, that replacement of either the teeter lever 9 or the pinion gear 7 requires that the entire mechanism be disassembled. Neither the pinion gear 7, nor the shaft 8 and teeter lever 9, are interchangeable. Consequently, these components must be replaced as a set. Moreover, the pneumatic differential engine, once assembled, becomes unique to a specific door configuration, and differential engines cannot usually be interchanged between different door configurations.

These factors impose both labor and material expense burdens upon the maintenance of door systems equipped with the present pneumatic differential engine.

SUMMARY OF THE INVENTION

It is therefore an object of the invention to provide a removable teeter lever/gear assembly arrangement for pneumatic cylinder/differential engine power-operated vehicle doors. It is a further object of the invention to provide a teeter lever/gear assembly arrangement which can be easily removed and replaced without disassembling the differential engine. It is still another object of the invention to provide a teeter lever/gear assembly wherein replacement of individual parts is easy and cost effective.

The present invention comprises a removable teeter lever and gear assembly arrangement for use with pneumatic cylinder/differential engine power-operated vehicle doors. The arrangement comprises a teeter lever which is associated with the vehicle doors via rods and levers to the vertical shafts and arms linked to the vehicle door panels, such that rotation of the teeter lever causes opening and closing of the vehicle doors. A gear assembly having a toothed member and an output shaft extending therethrough are provided such that rotational movement of the gear assembly is caused by actuation of the pneumatic cylinder/differential engine. A securing member in the form of at least one retention key cooperating with at least one keyway formed in the output shaft is provided for removably securing and/or retaining the teeter lever onto the output shaft and for removably securing and/or retaining the gear onto the output shaft.

These and other features and characteristics of the present invention, as well as the method of operation and functions of the related elements of structures and the combination of parts and economies of manufacture, will become more apparent upon consideration of the following description with reference to the accompanying drawings, all of which form a part of this specification, wherein like reference numerals designate corresponding parts in the various figures.

DETAILED DESCRIPTION OF THE INVENTION

Figure 1:
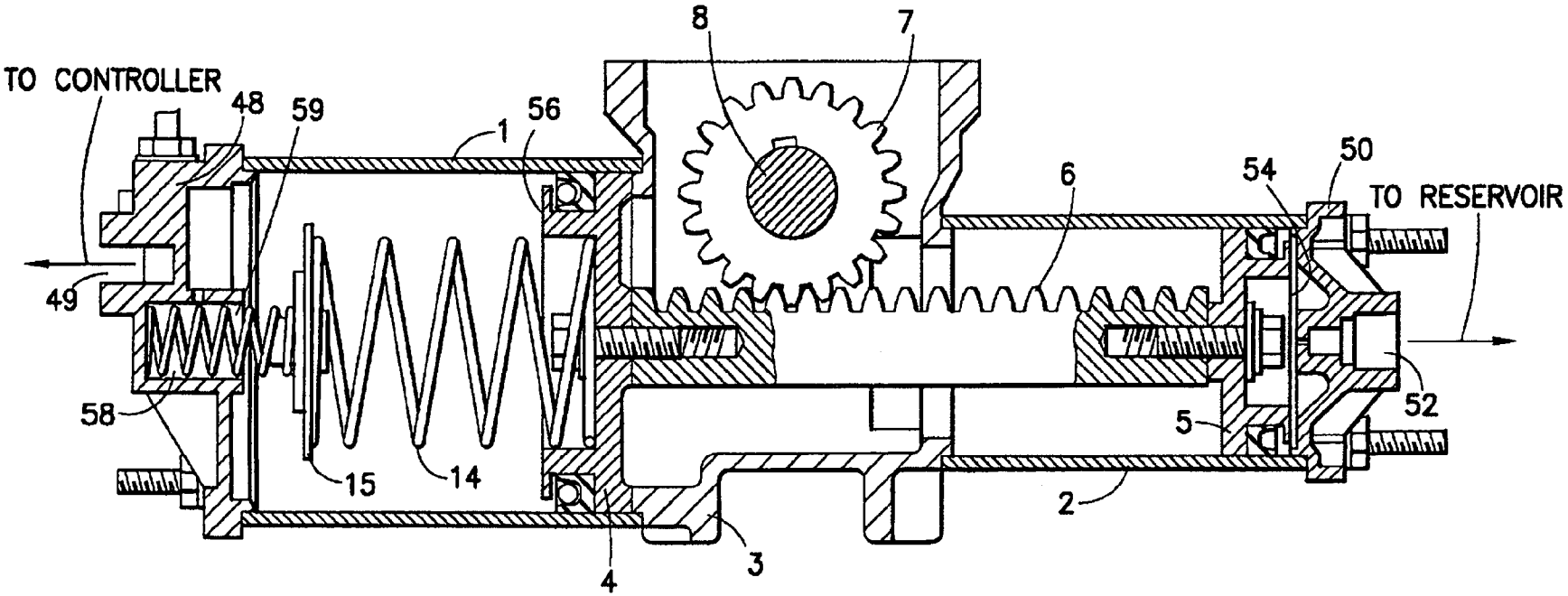
FIG. 1 PRIOR ART
FIG. 1 shows a schematic section view of the pneumatic cylinder/differential engine of the prior art for controlling power operated doors of a vehicle.
Figure 2:
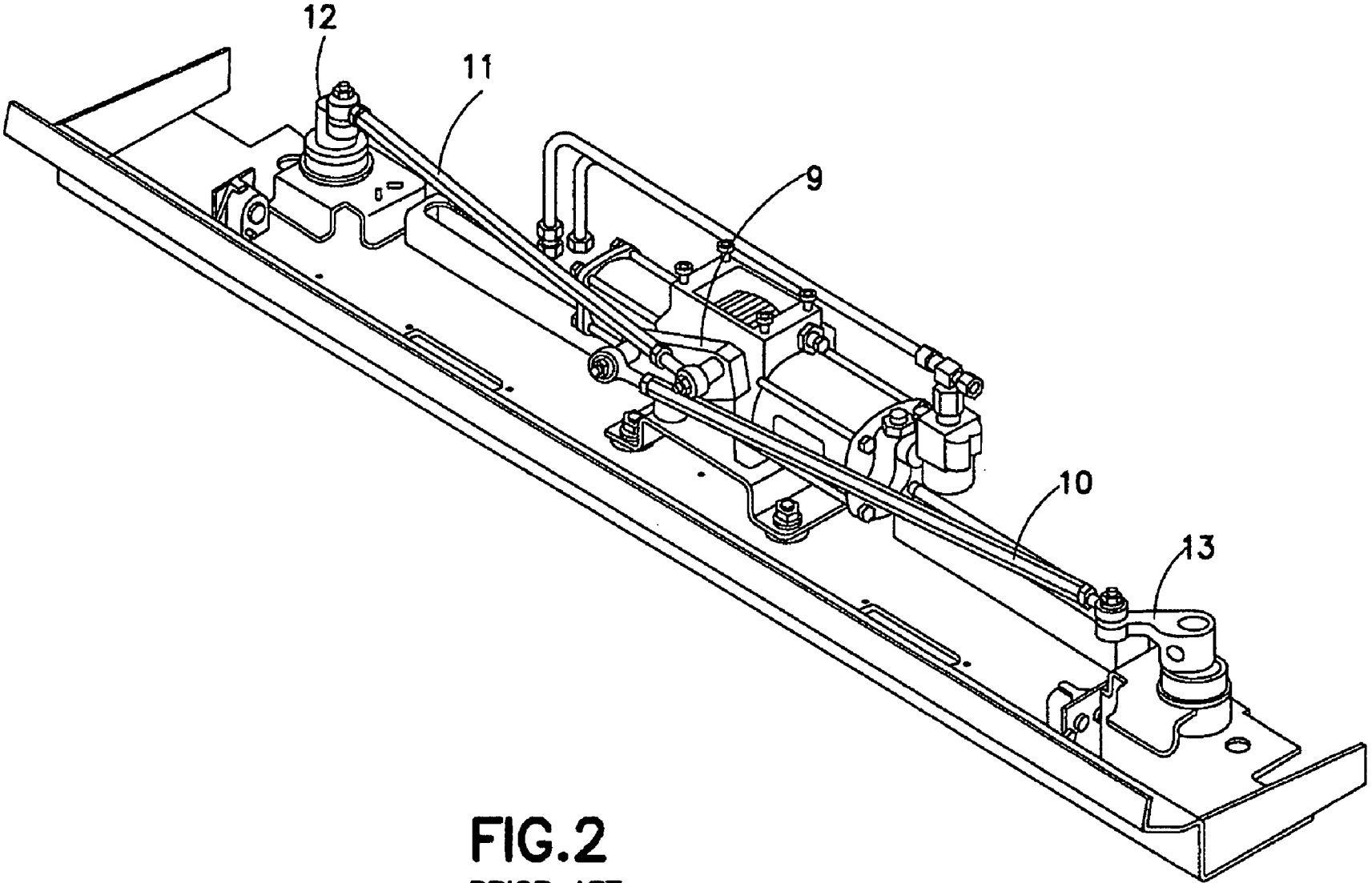
FIG.2 PRIOR ART
FIG. 2 shows a perspective view of the teeter lever/gear assembly arrangement of the prior art mounted on a vehicle.

For purposes of the description hereinafter, the terms "upper", "lower", "right", "left", "vertical", "horizontal", "top", "bottom", "lateral", "longitudinal" and derivatives thereof shall relate to the invention as it is oriented in the drawing figures. However, it is to be understood that the invention may assume various alternative variations, except where expressly specified to the contrary. It is also to be understood that the specific devices illustrated in the attached drawings, and described in the following specification, are simply exemplary embodiments of the invention. Hence, specific dimensions and other physical characteristics related to the embodiments disclosed herein are not to be considered as limiting.

Figure 3:
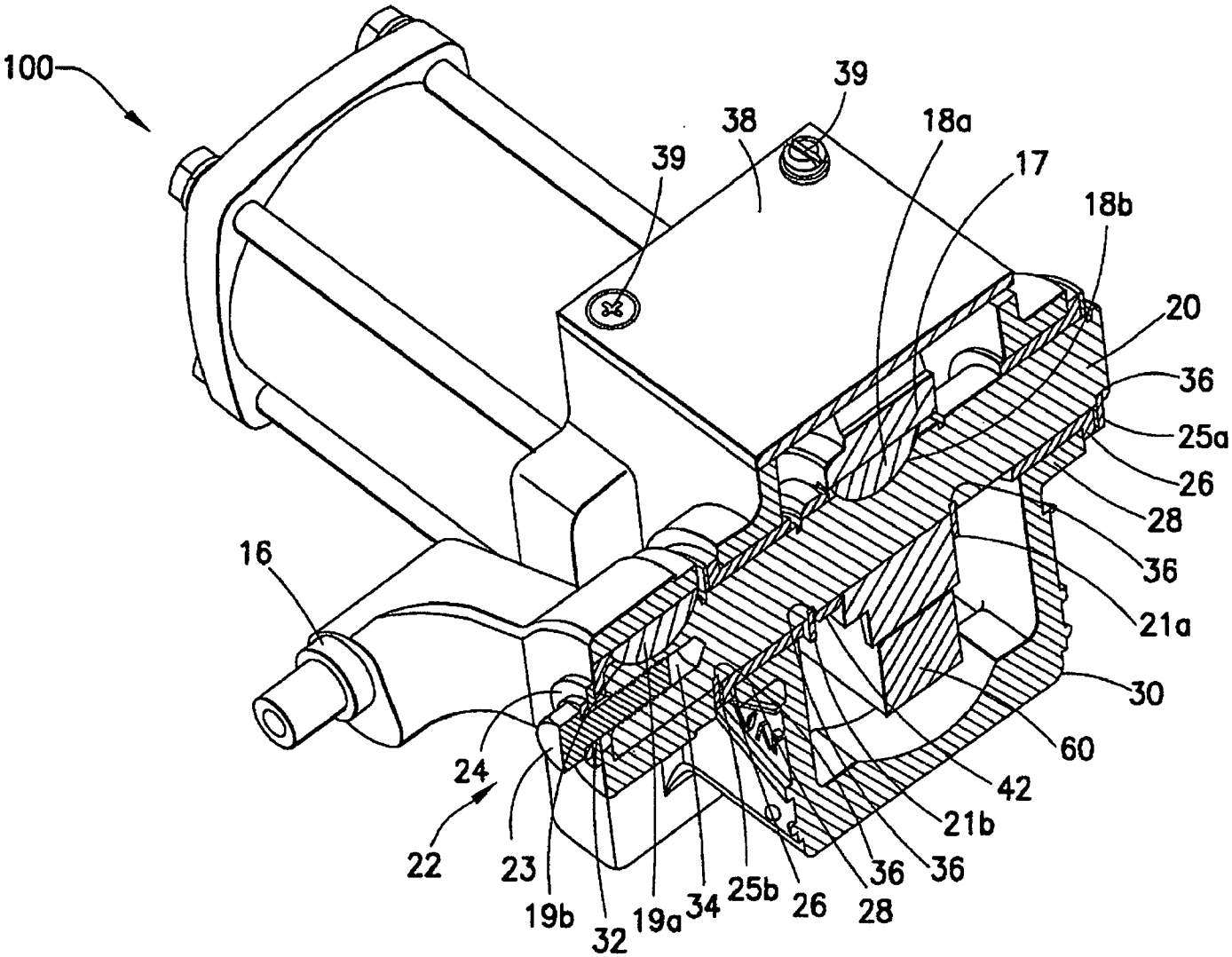
FIG. 3 shows a perspective view in partial section of the teeter lever/gear assembly arrangement in accordance with the present invention.
Figure 4:
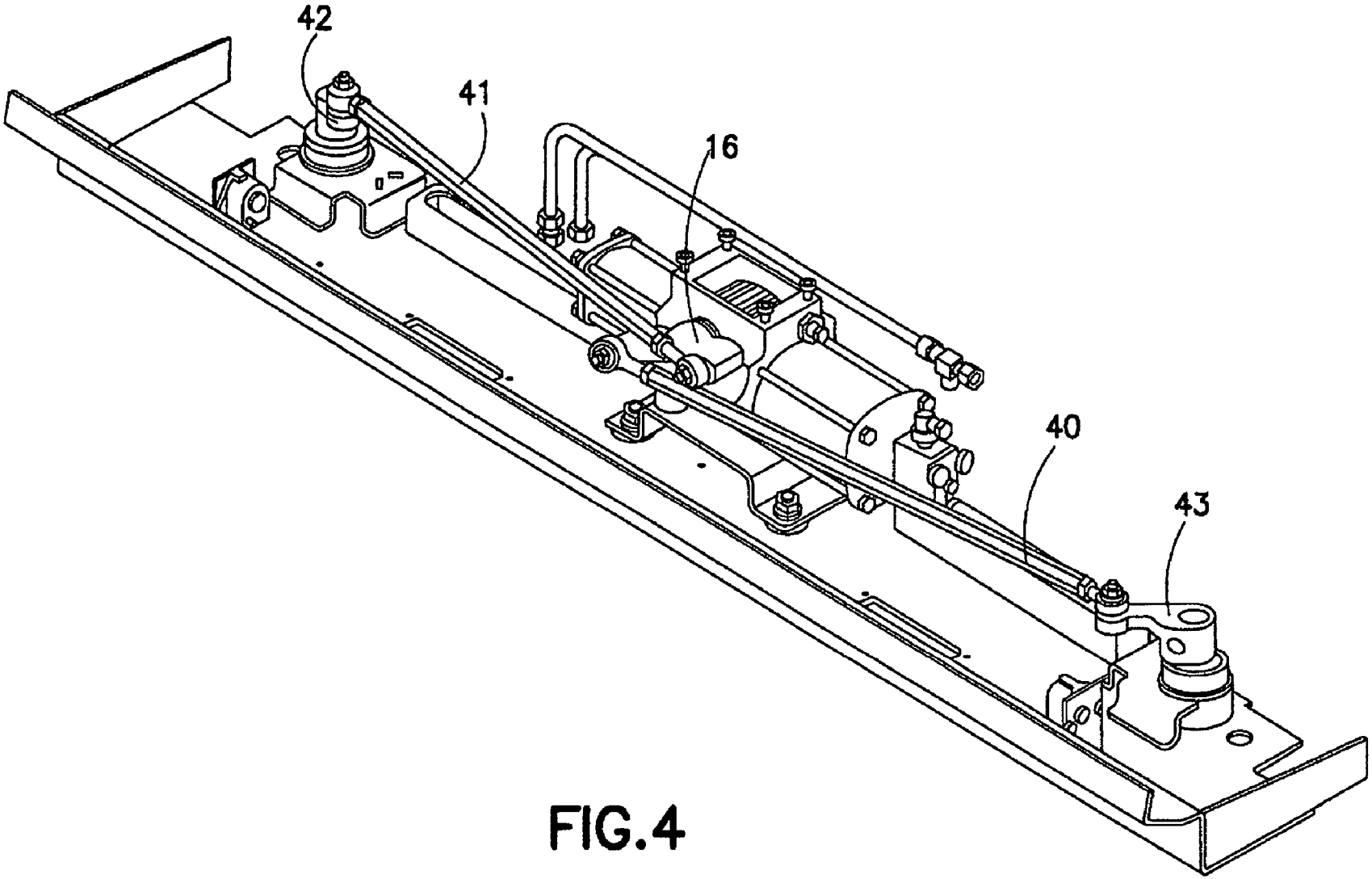
FIG. 4 shows a perspective view of the teeter lever/gear assembly arrangement of FIG. 3 mounted on a vehicle.

Reference is now made to FIG. 3, which shows the removable teeter lever/gear assembly arrangement of the present invention, generally indicated as 100, for use with a pneumatic cylinder/differential engine for opening and closing vehicle doors. As illustrated in FIG. 4, the removable teeter lever 16 is connected by the rods 40, 41 and levers 42, 43 to the vertical shafts and arms linked to the vehicle door panels (not shown). Referring back to FIG. 3, actuation of the pneumatic cylinder/differential engine during a door opening or closing operation causes a gear 17 to rotate with respect to a toothed rack 60, which causes rotation of an output shaft 20. This rotational movement of the output shaft 20 causes rotational movement of the teeter lever 16 which results in opening and closing of the vehicle doors.

As illustrated in detail in FIG. 3, the gear 17 is removably connected with a first portion of the output shaft 20 through the use of a first retention key 18*a*, which cooperates with a keyway 18*b* in the output shaft 20. The teeter lever 16 is removably connected with a second portion of the output shaft 20 through the use of a second retention key 19*a*, which cooperates with a second keyway 19*b* in the output shaft 20. The first and second retention keys 18*a*, 19*a* can comprise any well-known key design capable of attaching rotating circular members with one another. One example of retention keys 18*a*, 19*a*, which can be used with the present invention are Woodruff keys, which are removable keys that fit in a matching keyway cut into a shaft, leaving a protruding tab. The tab mates with a matching slot on a device mounted flush upon the shaft; e.g., a pulley, thus preventing the device from freely rotating about the shaft. Typically, a Woodruff key is a semicircular shaped or half-moon key that fits in a semicircular shaped matching keyway.

The gear 17 and output shaft 20 are prevented from axially moving within the arrangement 100 by holding members such as retaining rings as discussed in detail below. The gear 17 is prevented from moving axially on the output shaft 20 by a first pair of retaining rings 21*a*, 21*b* positioned on either side of the output shaft 20. The output shaft 20 is secured against axial motion relative to the gear housing 30 by a second pair of retaining rings 25*a*, 25*b* that bear against lubricant impregnated bushings 26 pressed into the sidewalls 28 of the gear housing 30. Retaining rings 21*a*, 21*b*, 25*a* and 25*b* preferably comprise split ring retaining rings which are seated within slight indentations 36 in the output shaft 20.

The teeter lever 16 is also secured against axial movement with respect to the output shaft 20 by a removable axial securing member, generally indicated as 22. This axial securing member 22 can comprise any well-known securing member which may be readily removed from the arrangement 100, such as a screw 23 and washer 24. The screw 23 is threaded through a first aperture 32 in the teeter lever 16, which is aligned with a second aperture 34 in the output shaft 20.

The keyways 18*b*, 19*b* in the output shaft 20 and the pinion gear 17 are manufactured with a standard angular relationship to one another. The position of the keyway 19*b* in the teeter lever 16 can be varied to adapt the final arrangement 100 to different door configurations.

Disassembly of the teeter lever 16 and gear assembly arrangement 100 occurs as follows. Removal of the teeter lever 16 from the arrangement 100 is achieved by simply removing screw 23 holding the teeter lever 16 to the output shaft 20. This allows the teeter lever 16 to be easily slid off the output shaft 20 and retention key 19*a*. The gear 17 may be removed from the arrangement without removing the teeter lever 16. This is achieved by a multiple-step process. Screws 39, which attach the cover portion 38 to the gear housing 30, are loosened and removed so that the cover portion 38 is removed. The split ring retaining member 25*a*, located adjacent housing 30 at the end opposite from the teeter lever 16, is removed from the output shaft 20. Then the "doors fully closed" target, not shown, is removed from the output shaft 20. Retaining ring 21*a*, adjacent gear 17, retaining ring 21*b*, and adjacent gear hub extension 42, are removed from the output shaft 20. The output shaft 20, including retention key 18*a*, can now be slid out from the interior portion of the gear 17 and the gear 17 can be lifted out of the gear housing 30 for repair and/or replacement thereof.

The present invention provides a differential engine wherein the teeter lever 16 and gear 17 can be easily removed and replaced. This significantly decreases the maintenance and/or labor required to correct a failure of the teeter lever 16 or of the pinion gear 17.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of this description. For example, it is to be understood that the present invention contemplates that, to the extent possible, one or more features of any embodiment can be combined with one or more features of any other embodiment.

The invention claimed is:

1. A drive arrangement for use with pneumatic engine for operating vehicle doors, said arrangement comprising:

(a) a housing, a gear assembly comprising a gear having an output shaft extending therethrough, said gear and a portion of said output shaft disposed within the housing, a teeter lever mounted on a portion said output shaft disposed outside of the housing, wherein rotational movement of said output shaft and said teeter lever is caused by actuation of said pneumatic engine; and (b) said teeter lever being associated with said vehicle doors such that rotation of said teeter lever causes said vehicle doors to move; said teeter lever including a first aperture and said output shaft including a second aperture wherein said first and second apertures are aligned and extend along a longitudinal axis of said output shaft, an axial securing member extends through said first and second apertures and prevents axial movement of said teeter lever with respect to said output shaft, (c) angular securing members removably securing said teeter lever to said output shaft and said gear to said output shaft such that said teeter lever and said gear are not able to rotate relative to said output shaft, said angular securing members comprising a first retention key cooperating with a keyway said gear and a first keyway formed within of said output shaft for removably connecting said gear to said output shaft and a second retention key cooperating with said teeter lever and a second keyway formed within said output shaft for removably connecting said teeter lever to said output shaft, and (d) a first pair of retaining rings each positioned on a respective side of said gear and limit axial movement of said gear relative to said output shaft and a second pair of retaining rings each positioned on a respective side of said housing and prevent axial movement of said output shaft with respect to said housing.

2. The arrangement of claim 1 wherein said first retention key and said second retention key each compromises a semi-circular-shaped key.

3. The arrangement of claim 1 wherein said axial securing member comprises a screw and a washer.

* * * * *

UNITED STATES PATENT AND TRADEMARK OFFICE

CERTIFICATE OF CORRECTION

PATENT NO. : 8,171,672 B2
APPLICATION NO. : 12/595850
DATED : May 8, 2012
INVENTOR(S) : Gennady Plavnik et al.

It is certified that error appears in the above-identified patent and that said Letters Patent is hereby corrected as shown below:

Column 5, Line 19, Claim 1, delete "with" and insert -- with a --

Column 5, Line 24, Claim 1, delete "portion" and insert -- portion of --

Column 6, Line 12, Claim 1, delete "a keyway said" and insert -- said --

Column 6, Line 13, Claim 1, "formed within of said" should read -- formed within said --

Column 6, Line 25, Claim 2, delete "compromises" and insert -- comprises --

Signed and Sealed this
Twenty-eighth Day of August, 2012

David J. Kappos

David J. Kappos
*Director of the United States Patent and Trademark Office*